US010607546B2

(12) United States Patent
Cheng

(10) Patent No.: US 10,607,546 B2
(45) Date of Patent: Mar. 31, 2020

(54) PIXEL CIRCUIT

(71) Applicant: AU Optronics Corporation, Hsin-Chu (TW)

(72) Inventor: Mao-Hsun Cheng, Hsin-Chu (TW)

(73) Assignee: AU OPTRONICS CORPORATION, Hsin-chu (TW)

( * ) Notice: Subject to any disclaimer, the term of this patent is extended or adjusted under 35 U.S.C. 154(b) by 1 day.

(21) Appl. No.: 16/009,716

(22) Filed: Jun. 15, 2018

(65) Prior Publication Data

US 2019/0164490 A1 May 30, 2019

(30) Foreign Application Priority Data

Nov. 28, 2017 (TW) ..... 106141430 A

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01); *G09G 2310/0251* (2013.01); *G09G 2320/0233* (2013.01); *G09G 2320/045* (2013.01)

(58) Field of Classification Search
None
See application file for complete search history.

(56) References Cited

U.S. PATENT DOCUMENTS

| | | | | |
|---|---|---|---|---|
| 7,023,408 | B2 | 4/2006 | Chen et al. | |
| 7,724,218 | B2 | 5/2010 | Kim et al. | |
| 8,466,855 | B2 | 6/2013 | Han | |
| 8,766,963 | B2 | 7/2014 | Lee et al. | |
| 9,269,296 | B2 | 2/2016 | Pyon | |
| 9,361,828 | B2 | 6/2016 | Tsai et al. | |
| 9,672,770 | B2 | 6/2017 | Yang et al. | |
| 2013/0249413 | A1 | 9/2013 | Chen et al. | |
| 2015/0028766 | A1* | 1/2015 | Yang | G09G 3/3225 315/240 |
| 2016/0035276 | A1 | 2/2016 | Yin et al. | |
| 2017/0116919 | A1 | 4/2017 | Ma | |

OTHER PUBLICATIONS

Taiwan Intellectual Property Office, Office Action dated May 21, 2018.

* cited by examiner

*Primary Examiner* — Kenneth B Lee, Jr.
(74) *Attorney, Agent, or Firm* — WPAT, PC

(57) ABSTRACT

A pixel circuit includes a light emitting component, a storage capacitor, a driving transistor, a first switch, a second switch, a third switch, and a fourth switch. A first end of the driving transistor is configured to receive a supply voltage, and a second end of the driving transistor is electrically connected to an anode end of the light emitting component. The first switch is configured to provide a first reference voltage to a second end of the storage capacitor. The second switch is configured to provide the supply voltage to the first end of the storage capacitor. The third switch and the fourth switch are configured to provide an operating voltage corresponding to a data voltage and a threshold voltage of the third switch to the second end of the storage capacitor.

22 Claims, 13 Drawing Sheets

PIXEL CIRCUIT

RELATED APPLICATIONS

This application claims priority to Taiwan Application Serial Number 106141430, filed Nov. 28, 2017, which is herein incorporated by reference.

BACKGROUND

Technical Field

The present disclosure relates to an electronic circuit. More particularly, the present disclosure relates to a pixel circuit.

Description of Related Art

With advances in technology, display devices are being increasingly used in our daily lives, such as used in smartphones and computers.

A typical display device may include a gate driving circuit, a source driving circuit, and a pixel circuit array. The gate driving circuit can sequentially provide a plurality of gate signals to the pixel circuits to turn on the switching transistors of the pixel circuits row by row. The source driving circuit can provide a plurality of data signals to the pixel circuits with the switching transistors thereof turned on to enable the pixel circuit to display according to the data signals.

The volume of the driving current provided to the organic light emitting diode by the driving transistor corresponds to the data signal and the threshold voltage of the driving transistor. However, threshold voltage offsets of the driving transistors in different pixel driving circuits may exist due to manufacturing processes. These offsets may cause uneven brightness of the organic light emitting diodes, and ultimately result in mura defects.

Thus, an important area of research in this field involves ways to overcome such a problem.

SUMMARY

One aspect of the present disclosure is related to a pixel circuit. In accordance with one embodiment of the present disclosure, the pixel circuit includes a light emitting component, a storage capacitor, a driving transistor, a first switch, a second switch, a third switch, and a fourth switch. The first end of the driving transistor is configured to receive a supply voltage, a second end of the driving transistor is electrically connected to an anode end of the light emitting component, and a control end of the driving transistor is electrically connected to a first end of the storage capacitor. The first switch is configured to provide a first reference voltage to a second end of the storage capacitor. The second switch is configured to provide the supply voltage to the first end of the storage capacitor. The third switch is electrically connected to the second end of the storage capacitor. The fourth switch is electrically connected to the third switch and configured to receive a data voltage. The third switch and the fourth switch are configured to provide an operating voltage corresponding to the data voltage and a threshold voltage of the third switch to the second end of the storage capacitor.

Another aspect of the present disclosure is related to a pixel circuit. In accordance with one embodiment of the present disclosure, the pixel circuit includes a light-emitting component, a storage capacitor, a driving transistor, a first switch, a second switch, a third switch, and a fourth switch. A first end of the driving transistor receives a supply voltage, a second end of the driving transistor is electrically connected to an anode end of the light emitting device, and a control end of the driving transistor is electrically connected to a first end of the storage capacitor. A first end of the first switch is electrically connected to a second end of the storage capacitor, and a second end of the first switch is configured to receive a first reference voltage. A first end of the second switch is electrically connected to the first end of the storage capacitor, and a second end of the second switch is configured to receive the supply voltage. A first end of the third switch is electrically connected to the second end of the storage capacitor, and a second end of the third switch is electrically connected to a control end of the third switch. A first end of the fourth switch is electrically connected to the second end of the third switch, and a second end of the fourth switch is configured to receive a data voltage.

Through application of one embodiment described above, a pixel circuit can be realized. By using such a pixel circuit in a display device, mura defects of the display device caused by the threshold voltage offset of the driving transistors can be avoided.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
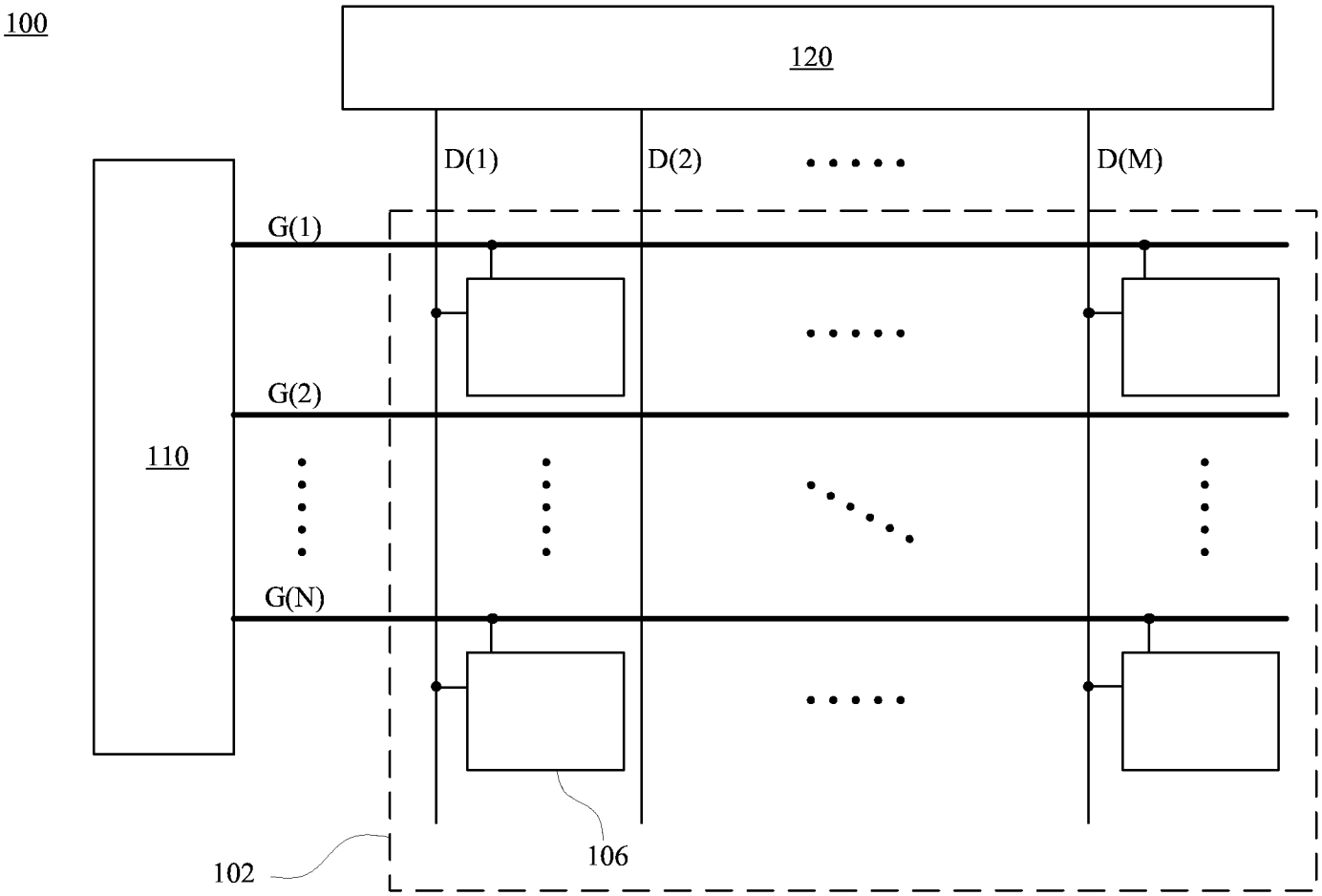
FIG. 1 is a schematic diagram of a display device according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

It will be understood that, in the description herein and throughout the claims that follow, although the terms "first," "second," etc. may be used to describe various elements, these elements should not be limited by these terms. These terms are only used to distinguish one element from another. For example, a first element could be termed a second element, and, similarly, a second element could be termed a first element, without departing from the scope of the embodiments.

It will be understood that, in the description herein and throughout the claims that follow, when an element is referred to as being "electrically connected" or "electrically coupled" to another element, it can be directly connected or coupled to the other element or intervening elements may be present. In contrast, when an element is referred to as being "directly connected" or "directly coupled" to another element, there are no intervening elements present. Moreover, "electrically connect" or "connect" can further refer to the interoperation or interaction between two or more elements.

It will be understood that, in the description herein and throughout the claims that follow, the terms "comprise" or "comprising," "include" or "including," "have" or "having," "contain" or "containing" and the like used herein are to be understood to be open-ended, i.e., to mean including but not limited to.

It will be understood that, in the description herein and throughout the claims that follow, the phrase "and/or" includes any and all combinations of one or more of the associated listed items.

It will be understood that, in the description herein and throughout the claims that follow, the meaning of "a," "an," and "the" includes reference to the plural unless the context clearly dictates otherwise.

It will be understood that, in the description herein and throughout the claims that follow, unless otherwise defined, all terms (including technical and scientific terms) have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any element in a claim that does not explicitly state "means for" performing a specified function, or "step for" performing a specific function, is not to be interpreted as a "means" or "step" clause as specified in 35 U.S.C. § 112(f). In particular, the use of "step of" in the claims herein is not intended to invoke the provisions of 35 U.S.C. § 112(f).

FIG. 1 is a schematic diagram of a display device 100 according to one embodiment of the present disclosure. The display device 100 can include a gate driving circuit 110, a source driving circuit 120, and a pixel array 102. The pixel array 102 may include a plurality of pixel circuits 106 arranged in a matrix. The gate driving circuit 110 can sequentially generate a plurality of gate signals G(1), . . . , G(N) and provide the gate signals G(1), . . . , G(N) to the pixel circuit 106 in the pixel array 102, so as to sequentially turn on the data switches (e.g., the switch T3 in FIG. 2) of the pixel circuits 106, in which N is an integer. The source driving circuit 120 can generate a plurality of data signals D(1), . . . , D(M) and provide the data signals D(1), . . . , D(M) to the pixel circuits 106 with the data switches therein turning on, so as to allow the pixel circuits 106 to operate according to the data signals D(1), . . . , D(M), in which M is an integer. Through such operation, the display device 100 can display images.

Figure 2:
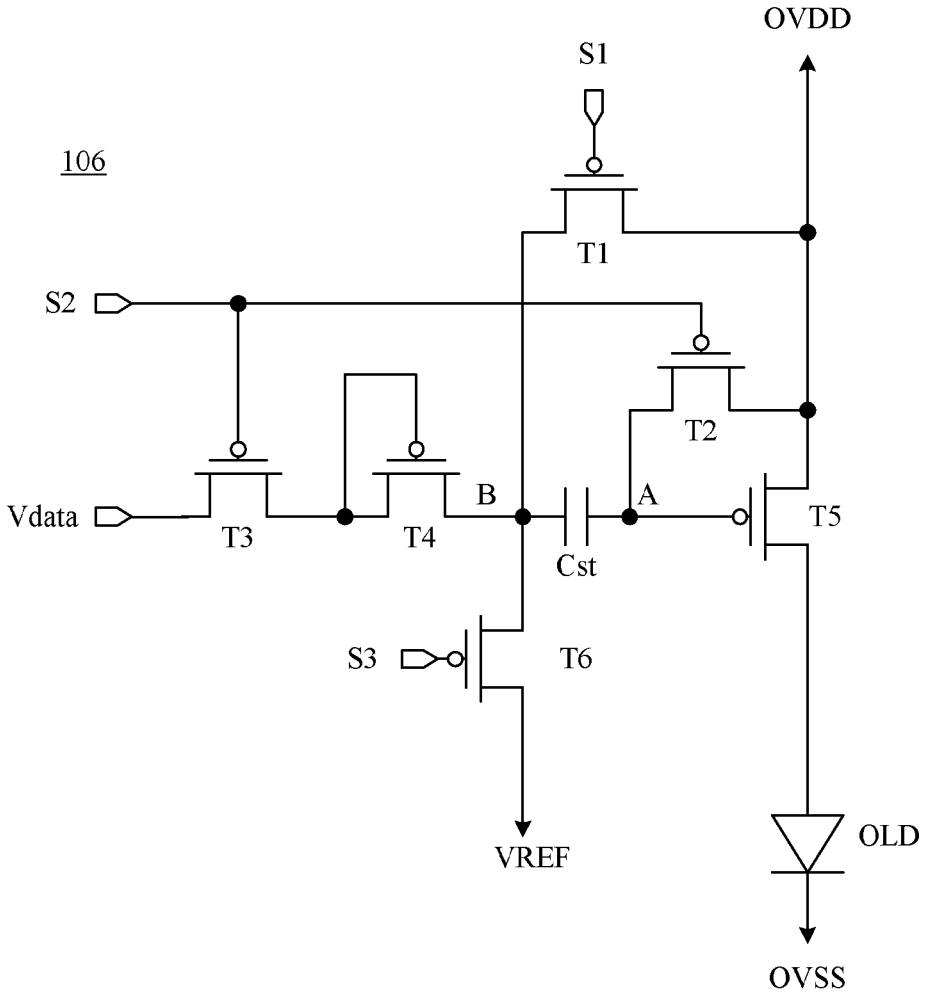
FIG. 2 is a schematic diagram of a pixel circuit according to one embodiment of the present disclosure.

FIG. 2 is a schematic diagram of the pixel circuit 106 according to one embodiment of the present disclosure. To simplify the description, only one pixel circuit 106 is taken as a descriptive example in the paragraphs below.

In this embodiment, the pixel circuit 106 receives one of the gate signals G(1), . . . , G(N) as gate signals S1-S3 (i.e., the one of the gate signals G(1), . . . , G(N) includes the gate signals S1-S3), and receives one of the data signals D(1), . . . , D(M) as a data voltage Vdata. In this embodiment, the gate signals S1-S3 are different from each other.

In this embodiment, the pixel circuit 106 includes a driving transistor T5, switches T1-T4, T6, a storage capacitor Cst, and a light-emitting component OLD. In one embodiment, the driving transistor T5 and the switches T1-T4, T6 may be implemented by using thin film transistors (TFTs). However, other types of switches and/or transistors are also within the contemplated scope of the present disclosure. In one embodiment, the driving transistor T5 and the switches T1-T4, T6 may be implemented by using p-type transistors, but the present disclosure is not limited in this regard. In one embodiment, the light-emitting device OLD can be implemented by using an organic light-emitting diode. However, other types of light-emitting devices are also within the contemplated scope of the present disclosure.

In this embodiment, the first end of the driving transistor T5 is electrically connected to a voltage source of a supply voltage OVDD, the second end of the driving transistor T5 is electrically connected to an anode end of the light emitting device OLD, and the control end of the driving transistor T5 is electrically connected to the first end of the storage capacitor Cst (hereinafter referred to as node A).

In this embodiment, the cathode end of the light emitting device OLD is electrically connected to a voltage source for supplying a voltage OVSS.

In this embodiment, the first end of the switch T1 is electrically connected to the voltage source of the supply voltage OVDD and is configured to receive the supply voltage OVDD. The second end of the switch T1 is electrically connected to the second end of the storage capacitor (hereinafter referred to as node B), and the control end of the switch T1 is configured to receive the gate signal S1. In one embodiment, the switch T1 is turned on according to the gate signal S1 to provide the supply voltage OVDD to node B.

The first end of the switch T2 is electrically connected to the voltage source of the supply voltage OVDD and is configured to receive the supply voltage OVDD. The second end of the switch T2 is electrically connected to node A, and the control end of the switch T2 is configured to receive the gate signal S2. In one embodiment, the switch T2 is configured to turn on according to the gate signal S2 to provide the supply voltage OVDD to node A.

The first end of the switch T3 is electrically connected to a data line for supplying the data voltage Vdata and is configured to receive the data voltage Vdata. The second end of the switch T3 is electrically connected to the first end of the switch T4, and the control end of the switch T3 is configured to receive the gate signal S2. In one embodiment, the switch T3 is configured to turn on according to the gate signal S2 to provide the data voltage Vdata to the first end of the switch T4.

The first end of the switch T4 is electrically connected to the control end of the switch T4, and the second end of the switch T4 is electrically connected to node B. In one embodiment, the switch T4 is configured to receive the data voltage Vdata from the switch T3 and provide an operating voltage to node B according to the data voltage Vdata, in which the operating voltage corresponds to a threshold voltage Vth_T4 of the switch T4 (e.g., a threshold voltage of the transistor in the switch T4) and the data voltage Vdata.

In other words, the switches T3 and T4 are configured to cooperatively provide the operating voltage corresponding to the data voltage Vdata and the threshold voltage Vth_T4 of the switch T4 to node B according to the data voltage Vdata from the data line and the gate signal S2.

The first end of the switch T6 is electrically connected to node B. The second end of the switch T6 is electrically connected to a voltage source of a reference voltage VREF and used to receive the reference voltage VREF. The control end of the switch T6 is configured to receive the gate signal S3. In one embodiment, the switch T6 is turned on according to the gate signal S3 to provide the reference voltage VREF to node B.

In the paragraphs below, an operative example of the pixel circuit 106 will be described with reference to FIG. 3 to FIG. 6.

Figure 3:
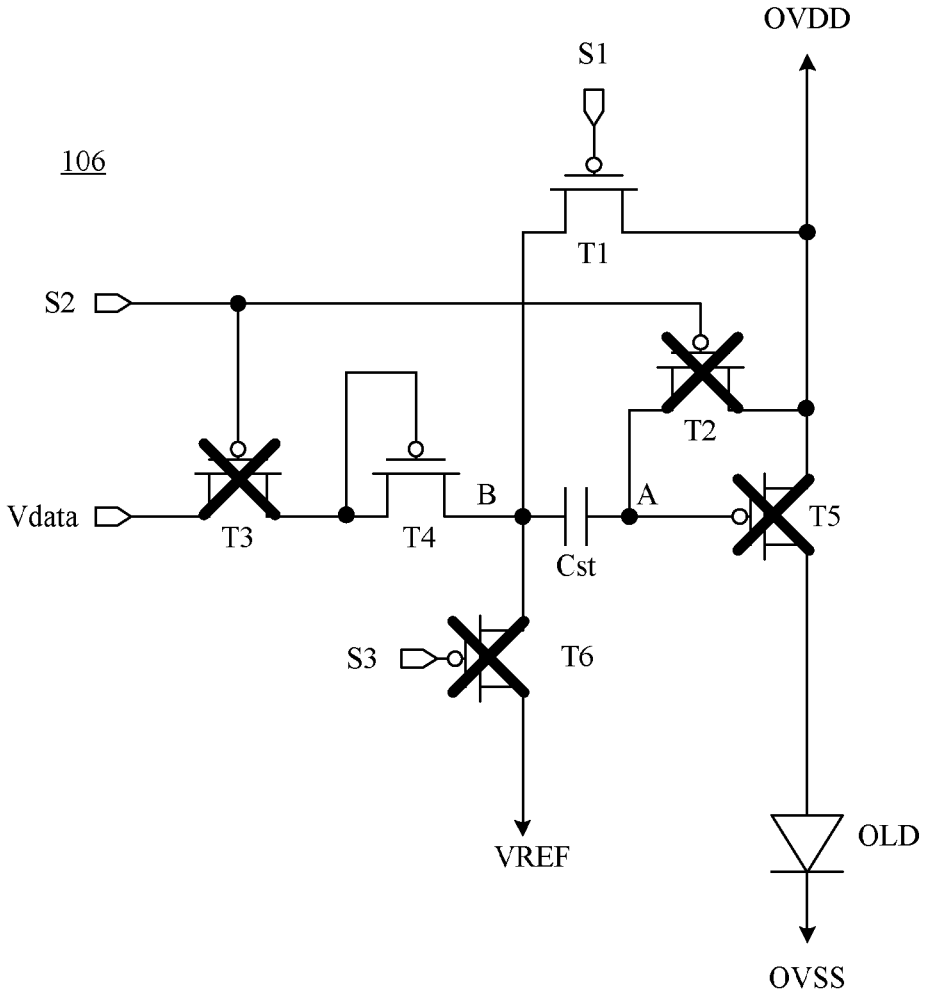
FIG. 3 illustrates an operating example of the pixel circuit according to one embodiment of the present disclosure.
Figure 6:
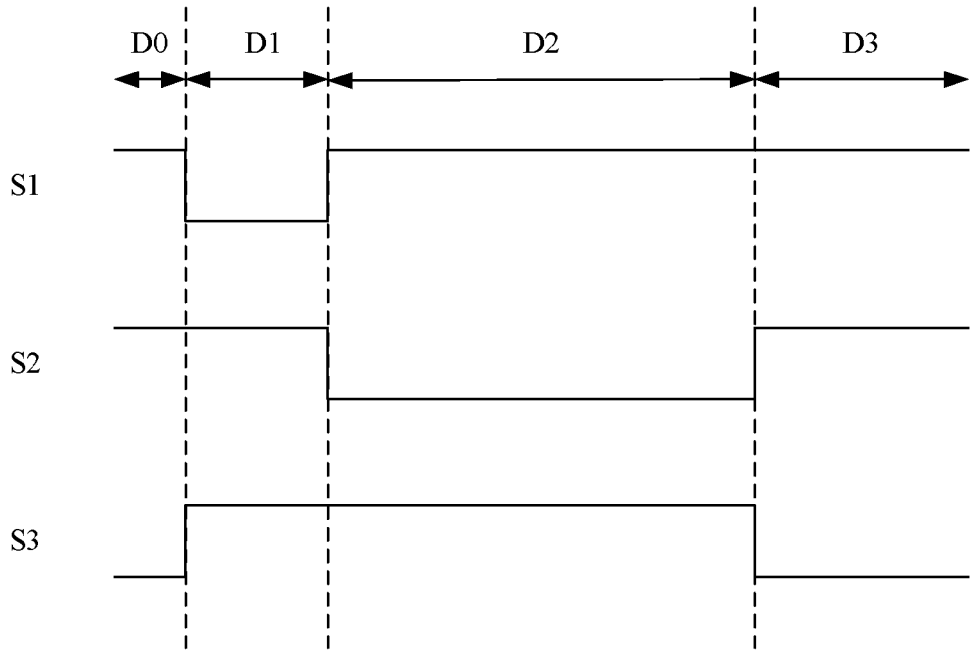
FIG. 6 is a signal diagram of the pixel circuit according to one operating example of the present disclosure.

Referring to FIG. 3 and FIG. 6, FIG. 3 illustrates an operating example of the pixel circuit 106 according to one embodiment of the present disclosure. FIG. 6 is a signal diagram of the pixel circuit 106 according to one operating example of the present disclosure.

In period D0 (e.g., a light-emitting stage of the previous frame), the voltage VA on node A can be expressed as VA=OVDD+VREF−Vdata_PRE−|Vth_T4|. The voltage Vdata_PRE represents the data voltage of the previous frame. The voltage VB on node B may be equal to the reference voltage VREF. The voltages VA, VB in this period will be further explained in the paragraph below corresponding to period D3.

During the period D1 (e.g., a reset stage), the gate signal S1 has a first voltage level (e.g., a low voltage level), and the gate signals S2 and S3 have second voltage levels (e.g., high voltage levels). In this period, the switches T2 and T3 are turned off according to the gate signal S2, and the switch T6 is turned off according to the gate signal S3. In this period, the switch T1 is turned on according to the gate signal S1 to provide the supply voltage OVDD to node B, so that the voltage VB on node B is changed from the reference voltage VREF to the supply voltage OVDD.

On the other hand, through the coupling effect of the capacitor Cst, in response to the variance of the voltage VB on node B (e.g., the voltage difference is equal to the supply voltage OVDD minus the reference voltage VREF), the voltage VA on node A changes to VA=2OVDD−Vdata_PRE.

At this time, the voltage difference Vsg_T5 between the source and the gate of the driving transistor T5 is equal to −OVDD+Vdata_PRE+|Vth_T4|. Therefore, if it is desired to turn off the driving transistor T5 in period D1, then the voltage difference Vsg_T5 could be smaller than the absolute value of the threshold voltage Vth_T5 of the driving transistor T5, and that is, −OVDD+Vdata_PRE+|Vth_T4|<|Vth_T5|. If the threshold voltages Vth_T4, Vth_T5 are set to be the same as each other, the above expression can be simplified to OVDD−Vdata_PRE>0.

In other words, by setting the threshold voltages Vth_T4 and Vth_T5 to be identical, and setting the data voltage (e.g., the data voltages Vdata_PRE, Vdata) of each frame to be less than the supply voltage OVDD, the driving transistor T5 can be turned off in period D1.

Figure 4:
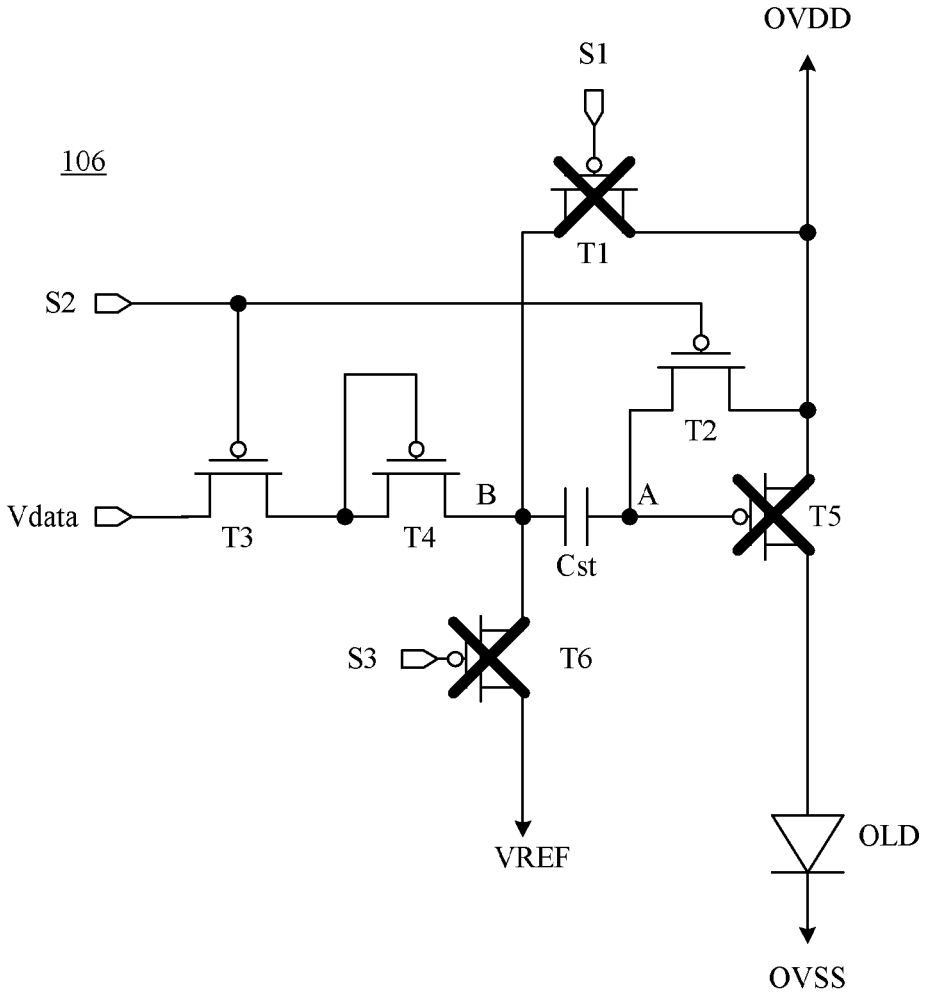
FIG. 4 illustrates an operating example of the pixel circuit according to one embodiment of the present disclosure.

Referring to FIG. 4 and FIG. 6, in period D2 (e.g., a data writing stage), the gate signals S1 and S3 have the second voltage levels (e.g., high voltage levels) and the gate signal S2 has the first voltage level (e.g., low voltage level). In this period, the switch T1 is turned off according to the gate signal S1, and the switch T6 is turned off according to the gate signal S3. In this period, the switch T2 is turned on according to the gate signal S2 to provide the supply voltage OVDD to node A, so that the voltage VA on node A is changed to the supply voltage OVDD. On the other hand, the switch T3 is turned on according to the gate signal S2 to provide the data voltage Vdata to the first end and the control end of the switch T4 to provide the operation voltage (e.g., the sum of the data voltage Vdata and the threshold voltage Vth_T4 of the switch T4) to node B through the switch T4, so that voltage VB on node B is changed to the operating voltage (i.e., VB=Vdata+Vth_T4).

Figure 5:
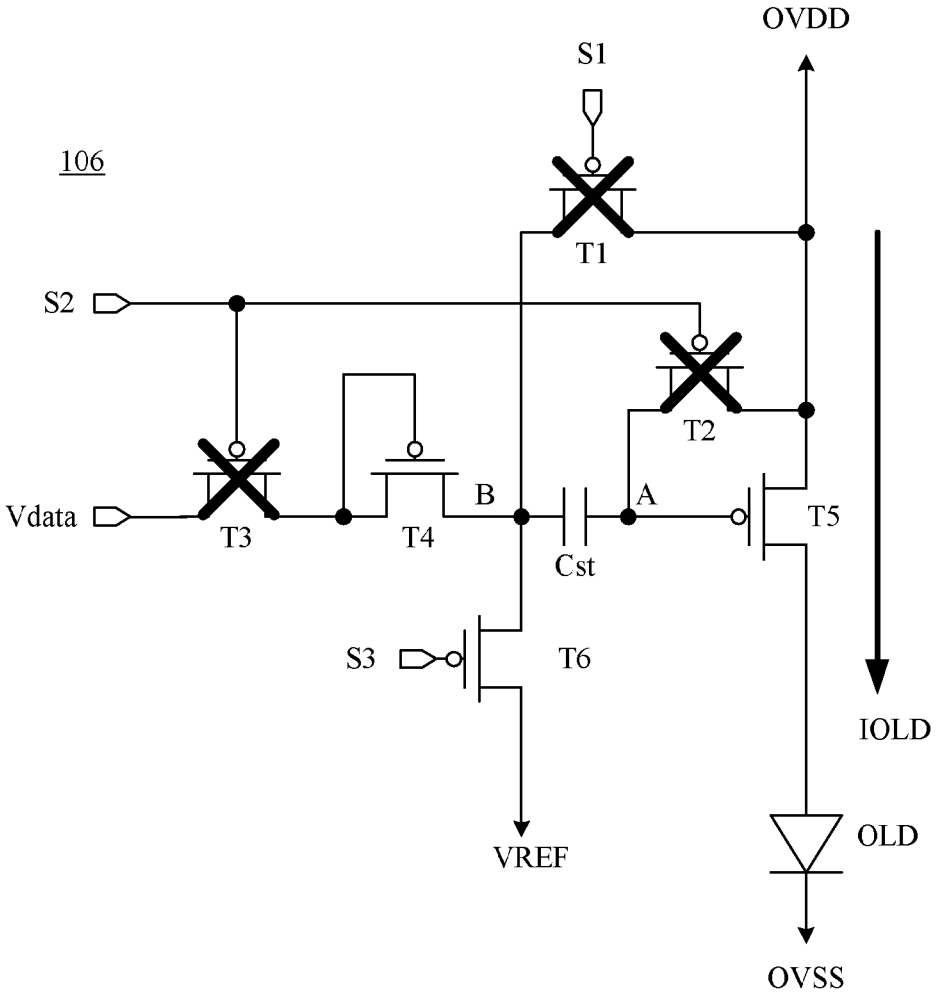
FIG. 5 illustrates an operating example of the pixel circuit according to one embodiment of the present disclosure.

Referring to FIG. 5 and FIG. 6, in period D3 (e.g., a light-emitting period), the gate signals S1 and S2 have the second voltage levels (e.g., high voltage levels) and the gate signal S3 has the first voltage level (e.g., low voltage level). In this period, the switch T1 is turned off according to the gate signal S1, and the switches T2 and T3 are turned off according to the gate signal S2. In this period, the switch T6 is turned on according to the gate signal S3 to provide the reference voltage VREF to node B to change the voltage VB on node B from the aforementioned operating voltage (i.e., Vdata+Vth_T4) to the reference voltage VREF.

On the other hand, through the coupling effect of the capacitor Cst, in response to the variance of the voltage VB on node B (e.g., the voltage difference is equal to the reference voltage VREF—the operating voltage (i.e., VREF−Vdata−Vth_T4)), the voltage VA on node A is changed to VA=OVDD+VREF−Vdata−|Vth_T4|.

At this time, according to current formula, the driving current IOLD through the driving transistor T5 can be expressed as IOLD=½K*(Vsg_T5−|Vth_T5|)^2=½K*(−VREF+Vdata+|Vth_T4|−Vth_T5|)^2. The parameter Vsg_T5 represents the voltage difference between the source and the gate of the driving transistor T5, and K is a constant. In the case that the preset threshold voltages Vth_T4 and Vth_T5 are the same as each other, the above equation can be simplified to IOLD=½K*(Vdata−VREF)^2. From the above equation, in period D3, the magnitude of the driving current IOLD is merely relevant to the reference voltage VREF and the data voltage Vdata, and is irrelevant to the threshold voltage Vth_T5 of the driving transistor T5.

Therefore, through the configuration above, mura defects of the display device 100 caused by threshold voltage offsets of the driving transistors T5 can be avoided.

Additionally, in the embodiment above, during period D3, since there do not exist other switches on the current path of the driving current IOLD other than the transistor T5, it can avoid a decrease of the driving current IOLD caused by the turn-on resistances of other switches, so as to avoid a slow response time of the light-emitting component OLD.

It should be noted that, in different embodiments, there may still exist other switches on the current path of the driving current IOLD, and the present embodiment is not limited to the above embodiments.

Figure 7:
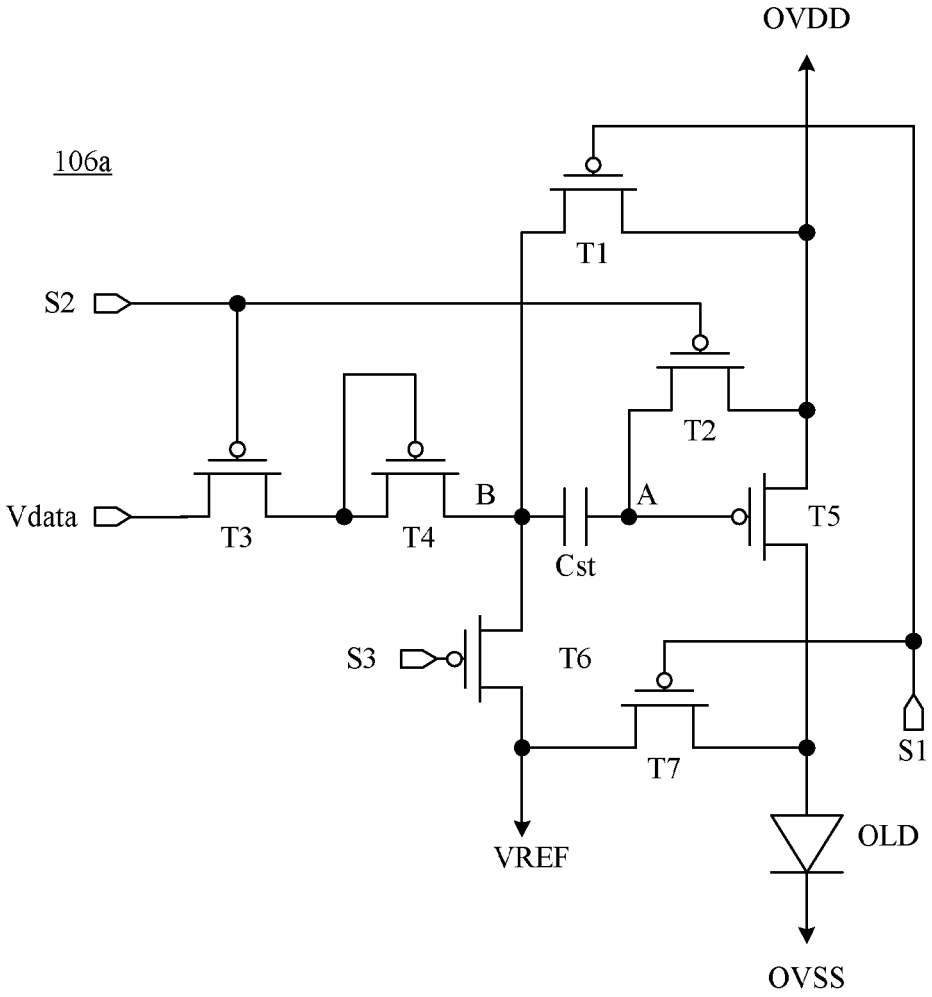
FIG. 7 is a schematic diagram of a pixel circuit according to another embodiment of the present disclosure.

FIG. 7 is a schematic diagram of a pixel circuit **106*a* according to another embodiment of the present disclosure. In the present embodiment, since the pixel circuit 106*a* is similar to the pixel circuit 106**, many aspects that are similar will not be repeated.

In this embodiment, the pixel circuit **106*a* further includes a switch T7. In an implementation, the switch T7 can be implemented by using a thin film transistor, but other types of switches and/or transistors are also within the contemplated scope of the present disclosure. In one embodiment, the switch T7** can be implemented by using a p-type transistor, but the present disclosure is not limited in this regard.

In this embodiment, the first end of the switch T7 is electrically connected to the anode end of the light emitting device OLD, the second end of the switch T7 is electrically connected to the voltage source of the reference voltage VREF, and the control end of the switch T7 is configured to receive gate signal S1. In one embodiment, the switch T7 is turned on according to the gate signal S1 to provide the reference voltage VREF to the anode end of the light emitting device OLD.

In one embodiment, in the aforementioned period D1, the switch T7 is turned on according to the gate signal S1 to provide the reference voltage VREF to the anode end of the light-emitting device OLD to reset the voltage on the anode end of the light-emitting device OLD. In one embodiment, the voltage difference between the reference voltage VREF and the supply voltage OVSS may be set to be smaller than the threshold voltage (e.g., turn-on voltage) of the light-emitting component OLD, so as to avoid the light-emitting component OLD incorrectly emitting lights during period D1.

In addition, in periods D2 and D3, the switch T7 is turned off according to the gate signal S1.

Figure 8:
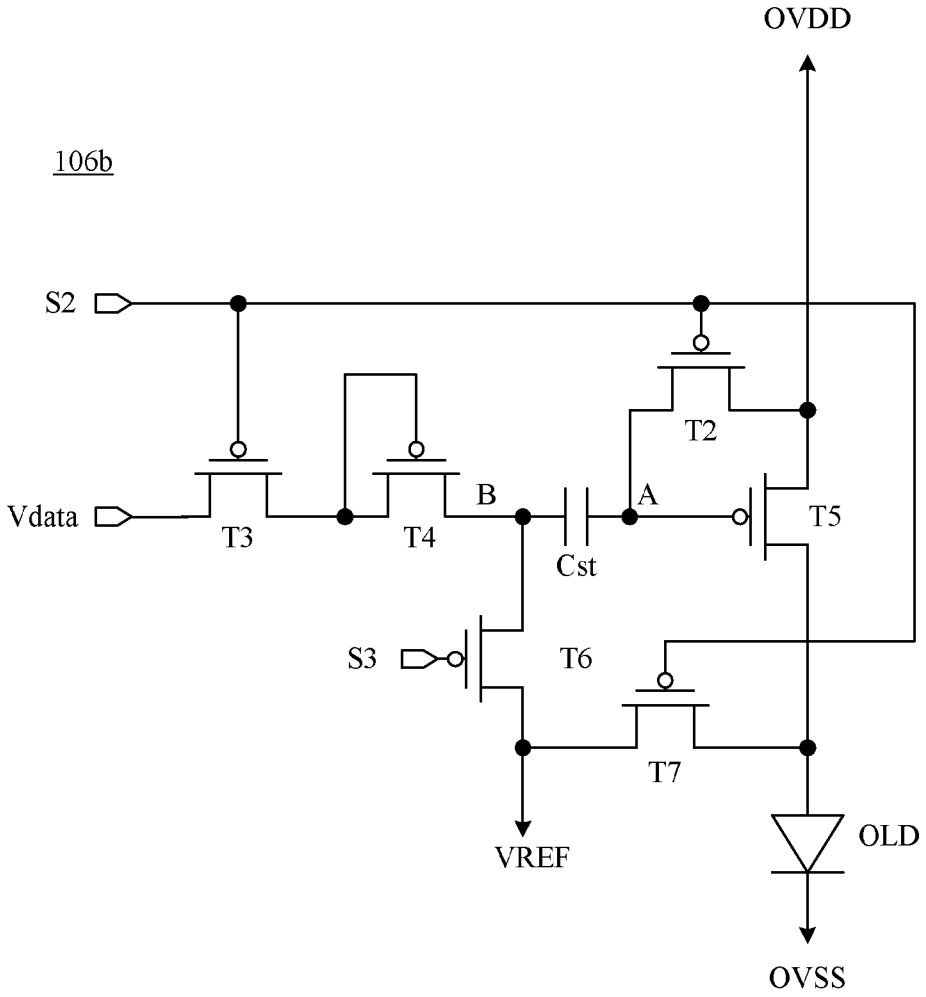
FIG. 8 is a schematic diagram of a pixel circuit according to another embodiment of the present disclosure.

FIG. 8 is a schematic diagram of a pixel circuit **106*b* according to another embodiment of the present disclosure. In the present embodiment, since the pixel circuit 106*b* is similar to the pixel circuit 106*a***, many aspects that are similar will not be repeated.

In this embodiment, compared to the pixel circuit **106*a***, the switch T1 is omitted and the control end of the switch T7 receives the gate signal S2, so that the gate signal S1 can be omitted. In addition, the reference voltage VREF received at the second end of the switch T6 may have different voltage levels. In the paragraphs below, the reference voltage VREF having the first reference voltage level is referred to as a first reference voltage VREF1, and the reference voltage VREF having the second reference voltage level is referred to as a second reference voltage VREF2. In one embodiment, the first reference voltage level and the second reference voltage level are different from each other, and the first reference voltage VREF1 and the second reference voltage VREF2 are different from each other. In one embodiment, the gate signals S2, S3 are 180 degrees out of phase with each other, and the gate signals S2, S3 may also be signal combinations that are not concurrently enabled.

The connection relationship between the driving transistor T5, the switches T2-T4, T6, T7, the storage capacitor Cst, and the light emitting component OLD of the pixel circuit **106*b* is substantially the same as the connection relationship thereof in the pixel circuit 106*a***. Thus, many aspect that are similar will not be repeated herein.

It should be noted that in various embodiments, the switch T7 of the pixel circuit **106*b*** can be selectively omitted, and the present disclosure is not limited to the circuit shown in FIG. 8.

Figure 9:
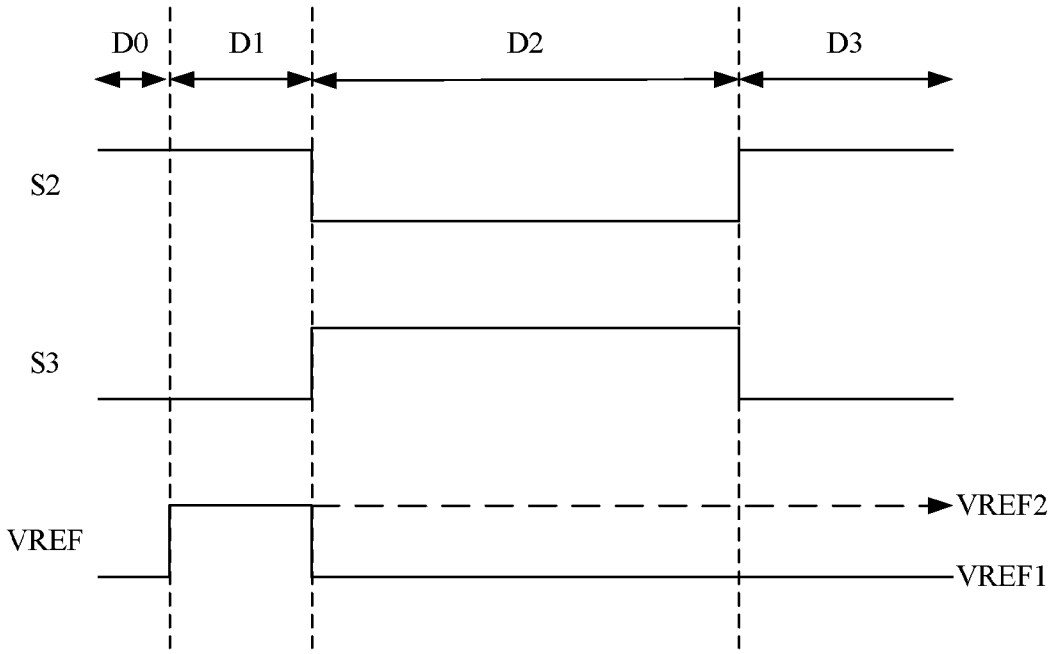
FIG. 9 is a schematic diagram of a pixel circuit according to another embodiment of the present disclosure.

Referring to FIG. 8 and FIG. 9, in period D0 (e.g., the light-emitting stage of the previous frame), the voltage VA on node A can be expressed as VA=OVDD+VREF1−Vdata_PRE−Vth_T4|. The voltage VB on node B may be equal to the first reference voltage VREF1. The voltages VA, VB in this period will be further explained in the paragraph below.

In period D1 (e.g., the reset period), the gate signal S3 has the first voltage level (e.g., low voltage level) and the gate signal S2 has the second voltage level (e.g., high voltage level). In this period, the switches T2, T3, and T7 are turned off according to the gate signal S2. In this period, the switch T6 is turned on according to the gate signal S3 to provide the second reference voltage VREF2 to node B, so that the voltage VB on node B changes from the first reference voltage VREF1 to the second reference voltage VREF2.

On the other hand, through the coupling effect of the capacitor Cst, in response to the variance of the voltage VB on node B (e.g., the voltage difference is equal to the second reference voltage VREF2 minus the first reference voltage VREF1), the voltage VA on node A changes to VA=2OVDD−Vdata_PRE−|Vth_T4|+VREF2. In the case that the second reference voltage VREF2 is set to the same voltage level as the supply voltage OVDD, the equation above can be simplified to VA=2OVDD−Vdata_PRE−|Vth_T4|.

At this time, the voltage difference Vsg_T5 between the source and the gate of the driving transistor T5 is −OVDD+Vdata_PRE+|Vth_T4|. Therefore, if it is desired to turn off the driving transistor T5 in period D1, the voltage difference Vsg_T5 could be smaller than the absolute value of the threshold voltage Vth_T5 of the driving transistor T5, that is, −OVDD+Vdata_PRE+|Vth_T4|<|Vth_T5|. Therefore, if the threshold voltages Vth_T4 and Vth_T5 are set to be the same as each other, the above expression can be simplified to OVDD−Vdata_PRE>0.

In other words, by setting the threshold voltages Vth_T4 and Vth_T5 to be identical and setting the data voltage (e.g., the data voltages Vdata_PRE, Vdata) of each frame to be less than the supply voltage OVDD, the driving transistor T5 can be turned off in period D1.

In period D2 (e.g., the data writing period), the gate signal S3 has the second voltage level (e.g., high voltage level) and the gate signal S2 has the first voltage level (e.g., low voltage level). In this period, the switch T6 is turned off according to the gate signal S3. In this period, the switch T2 is turned on according to the gate signal S2 to provide the supply voltage OVDD to node A, so that the voltage VA on node A is changed to the supply voltage OVDD. On the other hand, the switch T3 is turned on according to the gate signal S2 to provide the data voltage Vdata to the first end and the control end of the switch T4, so as to allow the switch T4 to provide the operating voltage (e.g., the sum of the data voltage Vdata and the threshold voltage Vth_T4 of the switch T4) to node B, so that voltage VB on node B is changed to the operating voltage (i.e., VB=Vdata+Vth_T4). In addition, the switch T7 is turned on according to the gate signal S2 to provide the first reference voltage VREF1 to the anode end of the light-emitting device OLD to reset the voltage on the anode end of the light-emitting device OLD. In one embodiment, the voltage difference between the first reference voltage VREF1 and the supply voltage OVSS may be set to be smaller than the threshold voltage of the light emitting device OLD, so as to avoid the light-emitting component OLD incorrectly emitting lights during period D1. In one embodiment, the first reference voltage VREF1 may be set to have the same voltage level as the supply voltage OVSS.

During the period D3 (e.g., the light-emitting period), the gate signal S2 has the second voltage level (e.g., high voltage level) and the gate signal S3 has the first voltage level (e.g., low voltage level). In this period, the switches T2, T3, and T7 are turned off according to the gate signal S2. In this period, the switch T6 is turned on according to the gate signal S3 to provide the first reference voltage VREF1 to node B, so that the voltage VB on node B is changed from the aforementioned operating voltage (i.e., Vdata+Vth_T4) to the first reference voltage VREF1.

On the other hand, through the coupling effect of the capacitor Cst, in response to the variance of the voltage VB on node B (e.g., the voltage difference is equal to the first reference voltage VREF1 minus the operating voltage (i.e., VREF1−Vdata−Vth_T4)), the voltage VA on node A is changed to VA=OVDD+VREF1−Vdata−|Vth_T4|.

At this time, according to the current formula, the driving current IOLD through the driving transistor T5 can be expressed as IOLD=½K*(Vsg_T5−|Vth_T5|) A 2=½K*(−VREF1+Vdata+|Vth_T4|−|Vth_T5|)^2. The parameter Vsg_T5 represents the voltage difference between the source and the gate of the driving transistor T5, and K is a constant. In the case that the threshold voltages Vth_T4 and Vth_T5 are the same as each other, the above equation can be simplified to IOLD=½K*(Vdata−VREF1)^2. From the above expression, in period D3, the magnitude of the driving current IOLD is merely relevant to the first reference voltage VREF1 and the data voltage Vdata, and is irrelevant to the threshold voltage Vth_T5 of the driving transistor T5.

Therefore, through the configuration above, mura defects of the display device 100 caused by threshold voltage offsets of the driving transistors T5 can be avoided.

Additionally, in the embodiment above, during period D3, since there do not exist other switches on the current path of the driving current IOLD other than the transistor T5, it can avoid a decrease of the driving current IOLD caused by the turn-on resistances of other switches, so as to avoid a slow response time of the light-emitting component OLD.

It should be noted that, in different embodiments, there may be other switches on the current path of the driving current IOLD. For example, a light-emitting control switch may exist on the current path of the driving current IOLD. That is, the driving transistor T5 may electrically connected to the light-emitting component OLD via a light-emitting control switch, and when the light-emitting control switch is turned on, the driving current IOLD passes through the light-emitting control switch and the light-emitting component OLD to allow the light-emitting component OLD to emit lights. The present disclosure is not limited to the above embodiments.

Figure 10:
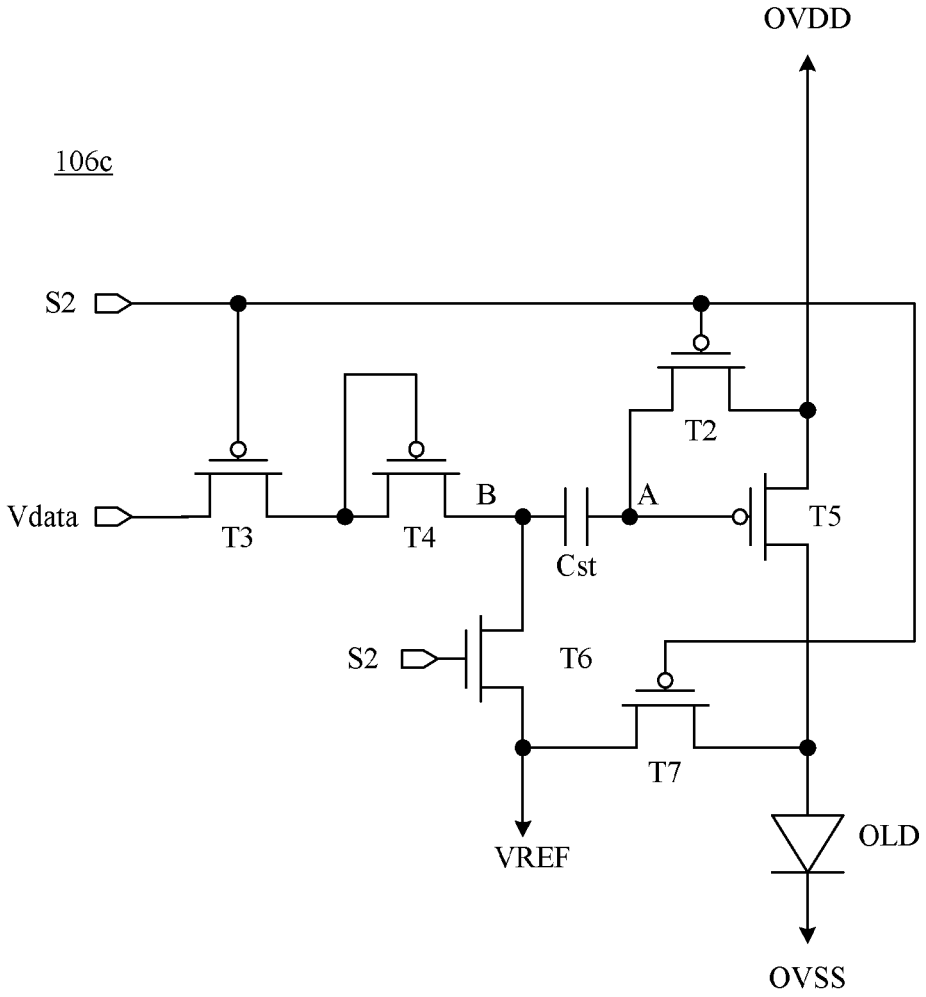
FIG. 10 is a schematic diagram of a pixel circuit according to another embodiment of the present disclosure.

FIG. 10 is a schematic diagram of a pixel circuit 106*c* according to another embodiment of the present disclosure. In the present embodiment, since the pixel circuit 106*c* is similar to the pixel circuit 106*b*, many aspects that are similar will not be repeated.

In this embodiment, compared to the pixel circuit 106*b*, the switch T6 in the pixel circuit 106*c* can be implemented by using an n-type transistor, and the control end of the switch T6 in the pixel circuit 106*c* can receive the gate signal S2, so that the gate signal S3 can be omitted.

It should be noted that in various embodiments, the switch T7 of the pixel circuit 106*c* can be selectively omitted, and the present disclosure is not limited to the circuit shown in FIG. 10.

Figure 11:
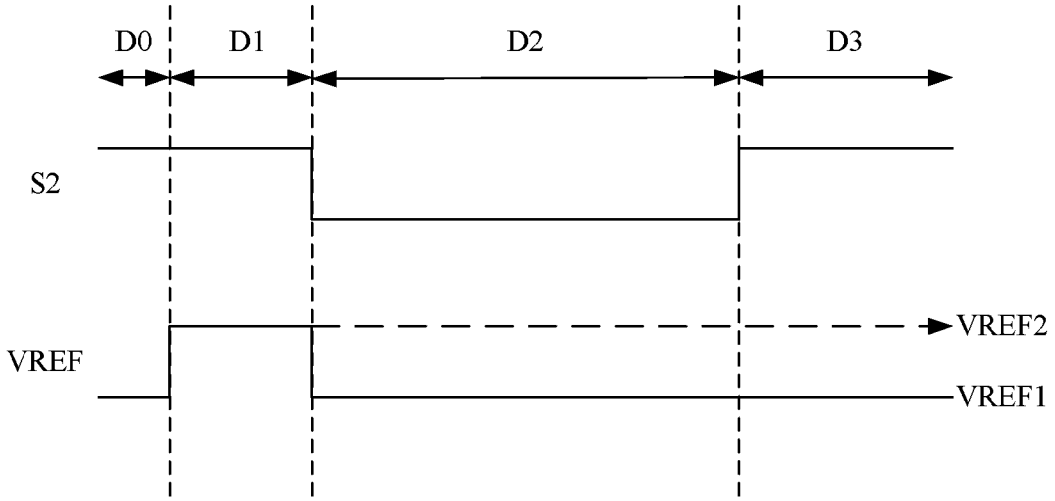
FIG. 11 is a schematic diagram of a pixel circuit according to another embodiment of the present disclosure.

Referring to FIG. 10 and FIG. 11, in period D0 (e.g., the light-emitting stage of the previous frame), the voltage VA on node A can be expressed as VA=OVDD+VREF1−Vdata_PRE−|Vth_T4|. The voltage VB on node B may be equal to the first reference voltage VREF1. The voltages VA, VB in this period will be further explained in the paragraph below.

In period D1 (e.g., the reset period), the gate signal S2 has the second voltage level (e.g., high voltage level). In this period, the switches T2, T3, and T7 are turned off according to the gate signal S2. In this period, the switch T6 is turned on according to the gate signal S2 to provide the second reference voltage VREF2 to node B, so that the voltage VB on node B changes from the first reference voltage VREF1 to the second reference voltage VREF2. On the other hand, the voltage VA on node A can be expressed as VA=2OVDD−Vdata_PRE−|Vth_T4|. Details in this regard can be ascertained with reference to the description above about the pixel circuit 106*b*.

During period D2 (e.g., the data writing period), the gate signal S2 has the first voltage level (e.g., low voltage level). In this period, the switch T6 is turned off according to the gate signal S2. In this period, the switch T2 is turned on according to the gate signal S2 to provide the supply voltage OVDD to node A. On the other hand, the switch T3 is turned on according to the gate signal S2 to provide the data voltage Vdata to the first end and the control end of the switch T4, to make the switch T4 provide the operating voltage (e.g., the sum of the data voltage Vdata and the threshold voltage Vth_T4 of the switch T4) to node B, so that voltage VB on node B is changed to the operating voltage (i.e., VB=Vdata+Vth_T4). In addition, the switch T7 is turned on according to the gate signal S2 to provide the first reference voltage VREF1 to the anode end of the light emitting device OLD. Details of the operations in period D2 can be ascertained with reference to the description above about the pixel circuit 106*b*.

During period D3 (e.g., the light-emitting period), the gate signal S2 has the second voltage level (e.g., high voltage level). In this period, the switches T2, T3, T7 are turned off according to the gate signal S2. In this period, the switch T6 is turned on according to the gate signal S2 to provide the first reference voltage VREF1 to node B. At this time, the voltage VA on node A can be expressed as VA=OVDD+VREF1−Vdata−|Vth_T4|. Details of the operations in period D3 can be ascertained with reference to the description above about the pixel circuit 106*b*.

Figure 12:
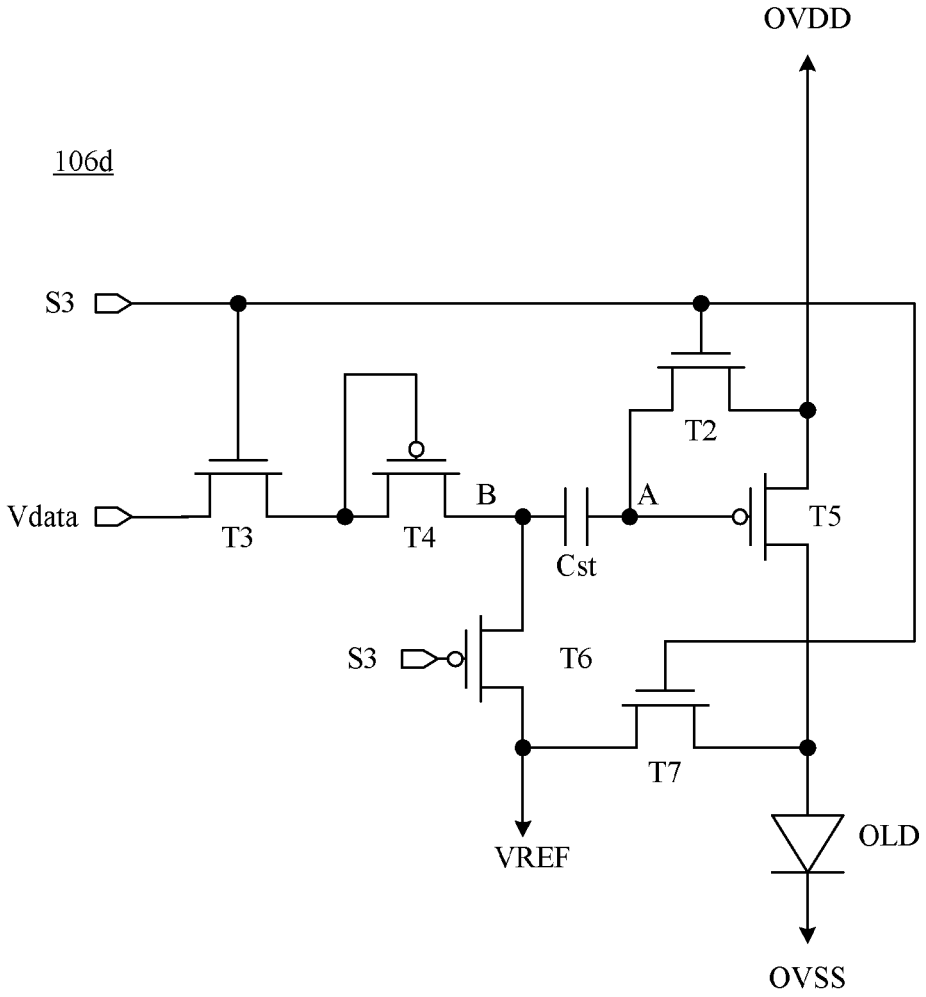
FIG. 12 is a schematic diagram of a pixel circuit according to another embodiment of the present disclosure.

FIG. 12 is a schematic diagram of a pixel circuit 106*d* according to another embodiment of the present disclosure. In the present embodiment, since the pixel circuit 106*d* is similar to the pixel circuit 106*b*, many aspects that are similar will not be repeated.

In the present embodiment, compared to the pixel circuit 106*b*, the switches T2, T3, T7 in the pixel circuit 106*d* can be implemented by using n-type transistors, and the control ends of the switches T2, T3, T7 in the pixel circuit 106*d* receive the gate signal S3, so that the gate signal S2 can be omitted.

It should be noted that in various embodiments, the switch T7 of the pixel circuit 106*d* can be selectively omitted, and the present disclosure is not limited to the circuit shown in FIG. 12.

Figure 13:
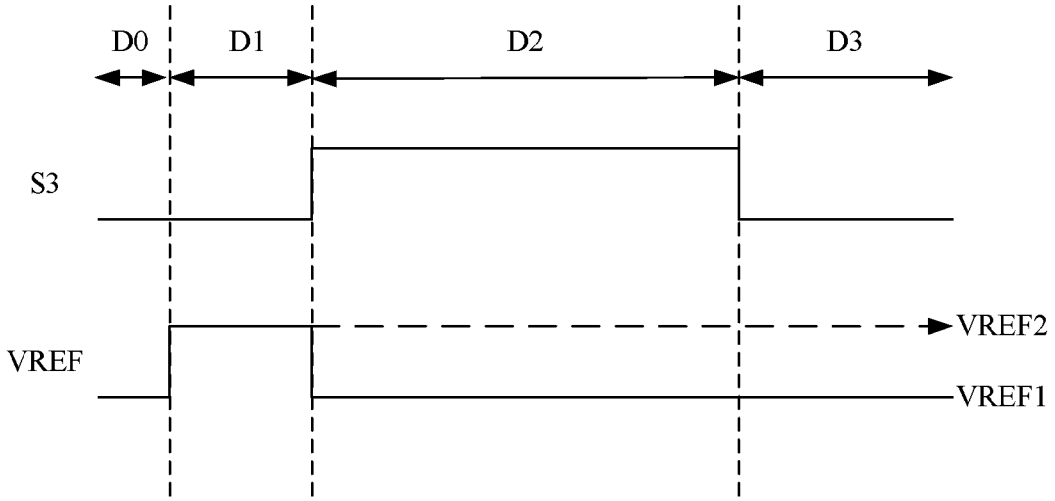
FIG. 13 is a signal diagram of the pixel circuit according to another embodiment of the present disclosure.

Referring to FIG. 12 and FIG. 13, in period D0 (e.g., the light-emitting stage of the previous frame), the voltage VA on node A can be expressed as VA=OVDD+VREF1−Vdata_PRE−|Vth_T4|. The voltage VB on node B may be equal to the first reference voltage VREF1. The voltages VA and VB in this period will be further explained in the following paragraphs.

During a period D1 (e.g., the reset period), the gate signal S3 has the first voltage level (e.g., low voltage level). In this period, the switches T2, T3, T7 are turned off according to the gate signal S3. In this period, the switch T6 is turned on according to the gate signal S3 to provide the second reference voltage VREF2 to node B, so that the voltage VB on node B changes from the first reference voltage VREF1 to the second reference voltage VREF2. On the other hand, the voltage VA on node A can be expressed as VA=2OVDD−Vdata_PRE−|Vth_T4|. Details in this regard can be ascertained with reference to the description above about the pixel circuit 106*b*.

During period D2 (e.g., the data writing period), the gate signal S3 has the second voltage level (e.g., high voltage level). In this period, the switch T6 is turned off according to the gate signal S3. In this period, the switch T2 is turned on according to the gate signal S3 to provide the supply voltage OVDD to node A. On the other hand, the switch T3 is turned on according to the gate signal S3 to provide the data voltage Vdata to the first end and the control end of the switch T4, so as to make the switch T4 provide the operating voltage (e.g., the sum of the data voltage Vdata and the threshold voltage Vth_T4 of the switch T4) to node B, so that voltage VB on node B is changed to the operating voltage (i.e., VB=Vdata+Vth_T4). In addition, the switch T7 is turned on according to the gate signal S3 to provide the first reference voltage VREF1 to the anode end of the light emitting device OLD. Details of the operations of the pixel circuit 106*d* in period D2 can be ascertained with reference to the description above about the pixel circuit 106*b*.

In period D3 (e.g., the light-emitting period), the gate signal S3 has the first voltage level (e.g., low voltage level). In this period, the switches T2, T3, T7 are turned off according to the gate signal S3. In this period, the switch T6 is turned on according to the gate signal S3 to provide the first reference voltage VREF1 to node B. At this time, the voltage VA on node A can be expressed as VA=OVDD+VREF1−Vdata−|Vth_T4|. Details of the operations in period D3 can be ascertained with reference to the description above about the pixel circuit 106*b*.

Although the present disclosure has been described in considerable detail with reference to certain embodiments thereof, other embodiments are possible. Therefore, the scope of the appended claims should not be limited to the description of the embodiments contained herein.

What is claimed is:

1. A pixel circuit comprising:

a light emitting component;

a storage capacitor;

a driving transistor, wherein a first end of the driving transistor is configured to receive a supply voltage, a second end of the driving transistor is electrically connected to an anode end of the light emitting component, and a control end of the driving transistor is electrically connected to a first end of the storage capacitor;

a first switch providing a first reference voltage to a second end of the storage capacitor;

a second switch providing the supply voltage to the first end of the storage capacitor;

a third switch electrically connected to and providing a data voltage to the second end of the storage capacitor; and a fourth switch electrically connected to the third switch, wherein the fourth switch receives the data voltage and provides the data voltage to the third switch;

wherein the third switch and the fourth switch provide an operating voltage corresponding to the data voltage and a threshold voltage of the third switch to the second end of the storage capacitor.

2. The pixel circuit as claimed in claim 1 further comprises:

a fifth switch providing the first reference voltage to the anode end of the light emitting component.

3. The pixel circuit as claimed in claim 1 further comprising:

a sixth switch providing the supply voltage to the second end of the storage capacitor.

4. The pixel circuit as claimed in claim 3, wherein in a first stage, the sixth switch is turned on according to a first gate signal to provide the supply voltage to the second end of the storage capacitor, and the first switch, the second switch and the fourth switch are turned off.

5. The pixel circuit as claimed in claim 3, wherein in a second stage, the second switch is turned on according to a second gate signal to provide the supply voltage to the first end of the storage capacitor, the fourth switch is turned on according to the second gate signal to provide the data voltage to the third switch, and the first switch and the sixth switch are turned off.

6. The pixel circuit as claimed in claim 3, wherein in a third stage, the first switch is turned on according to a third gate signal to provide the first reference voltage to the second of the storage capacitor, so as to allow the driving transistor to drive the light-emitting component, and the second switch, the fourth switch, and the sixth switch are turned off.

7. The pixel circuit as claimed in claim 3, wherein the first switch further provides a second reference voltage to the second end of the storage capacitor.

8. The pixel circuit as claimed in claim 7, wherein in a first stage, the first switch is turned on according to a first gate signal to provide a second reference voltage to the second of the storage capacitor end, and the second switch and the fourth switch are turned off.

9. The pixel circuit as claimed in claim 7, wherein in a second stage, the second switch is turned on according to a second gate signal to provide the supply voltage to the first end of the storage capacitor, the fourth switch is turned on according to the second gate signal to provide the data voltage to the third switch, and the first switch is turned off.

10. The pixel circuit as claimed in claim 7, wherein in a third stage, the first switch is turned on according to the first gate signal to provide the first reference voltage to the second of the storage capacitor, so as to allow the driving transistor to drive the light-emitting component, and the second switch and the fourth switch are turned off.

11. The pixel circuit as claimed in claim 7, wherein the second switch and the fourth switch are turned on according to a first voltage level of a gate signal, and the first switch is turned on according to a second voltage level of the gate signal.

12. The pixel circuit as claimed in claim 1, wherein a first end of the third switch is electrically connected to a control end of the third switch.

13. The pixel circuit as claimed in claim 1, wherein the threshold voltage of the third switch is substantially equal to a threshold voltage of the driving transistor.

14. A pixel circuit, comprising:

a light-emitting component;

a storage capacitor;

a driving transistor, wherein a first end of the driving transistor receives a supply voltage, a second end of the driving transistor is electrically connected to an anode end of the light emitting device, and a control end of the driving transistor is electrically connected to a first end of the storage capacitor;

a first switch, wherein a first end of the first switch is electrically connected to a second end of the storage capacitor, and a second end of the first switch is configured to receive a first reference voltage;

a second switch, wherein a first end of the second switch is electrically connected to the first end of the storage capacitor, and a second end of the second switch is configured to receive the supply voltage;

a third switch, wherein a first end of the third switch is electrically connected to the second end of the storage capacitor, and a second end of the third switch is electrically connected to a control end of the third switch; and a fourth switch, wherein a first end of the fourth switch is electrically connected to the second end of the third switch, and a second end of the fourth switch receives a data voltage.

15. The pixel circuit as claimed in claim 14 further comprising:

a fifth switch, wherein a first end of the fifth switch is electrically connected to the anode end of the light emitting device, and a second end of the fifth switch is configured to receive the first reference voltage.

16. The pixel circuit as claimed in claim 15 further comprising:

a sixth switch, wherein a first end of the sixth switch is electrically connected to the second end of the storage capacitor, and a second end of the sixth switch is configured to receive the supply voltage.

17. The pixel circuit as claimed in claim 16, wherein a control end of the first switch is configured to receive a first gate signal, a control end of the second switch and a control of the fourth switch receiving a second gate signal, and a control end of the fifth switch and a control end of the sixth switch receiving a third gate signal, wherein the first gate signal, the second gate signal and the third gate signal are different from each other.

18. The pixel circuit as claimed in claim 15, wherein the second end of the first switch further receives a second reference voltage, wherein the second reference voltage is different from the first reference voltage.

19. The pixel circuit as claimed in claim 18, wherein a control end of the first switch receives a first gate signal, a control end of the second switch, a control of the fourth switch, and a control end of the fifth switch receive a second gate signal, wherein the first gate signal and the second gate signal are different.

20. The pixel circuit as claimed in claim 18, wherein a control end of the first switch, a control end of the second switch, a control end of the fourth switch, and a control end of the fifth switch receive the same gate signal.

21. The pixel circuit as claimed in claim 14, wherein the first switch is manufactured by using a p-type transistor, and the second switch, the fourth switch, and the fifth switch are manufactured by using n-type transistors.

22. The pixel circuit as claimed in claim 14, wherein the first switch is manufactured by using a n-type transistor, the second switch, the fourth switch, and the fifth switch are manufactured by using p-type transistors.

* * * * *